US005595643A

United States Patent [19]

Torimoto et al.

[11] Patent Number: 5,595,643

[45] Date of Patent: Jan. 21, 1997

[54] METHOD FOR GENERATING NEGATIVELY CHARGED OXYGEN ATOMS AND APPARATUS USED THEREFOR

[75] Inventors: Yoshifumi Torimoto, Wakayama; Masayoshi Sadakata, 2-31-24, Koenji Minami, Suginami-ku, Tokyo, both of Japan

[73] Assignees: Kao Corporation; Masayoshi Sadakata, both of Tokyo, Japan

[21] Appl. No.: 449,852

[22] Filed: May 24, 1995

[51] Int. Cl.[6] ..... C25B 1/02

[52] U.S. Cl. ..... 205/634; 205/615; 205/633; 204/260; 204/265; 204/266

[58] Field of Search ..... 204/129, 260, 204/265, 266; 205/633, 634, 784, 615

[56] References Cited

U.S. PATENT DOCUMENTS

| | | | |
|---|---|---|---|
| 3,791,937 | 10/1971 | Besson et al. | 205/784 |
| 5,021,137 | 6/1991 | Joshi et al. | 204/129 |
| 5,205,990 | 4/1993 | Lawless | 422/121 |
| 5,302,258 | 4/1994 | Renlund et al. | 204/129 |
| 5,413,683 | 5/1995 | Murase et al. | 205/784 |

FOREIGN PATENT DOCUMENTS 62-237733 10/1987 Japan .

OTHER PUBLICATIONS

"Dense-Ceramic Oxygen Conducting Membranes", GRI-90/0303; Apr. 1989 through Sep. 1990; pp. 33–35.

Iwamoto, Masakazu et al., "Formation of $O^-$ Radical and Its Reactivity over Metal Oxides", vol. 40, No. 8, pp. 694–707 (1982). No month available.

*Primary Examiner*—Bruce F. Bell
*Assistant Examiner*—Kishor Mayekar
*Attorney, Agent, or Firm*—Oblon, Spivak, McClelland, Maier & Neustadt, P.C.

[57] ABSTRACT

Negatively charged oxygen atoms can be generated by the steps of (A) supplying oxygen to a surface of a solid electrolyte, at which the surface is provided an electrode A', while supplying electric current to the electrode A', to thereby form oxygen ions; (B) causing the oxygen ions formed in step (A) to be transmitted through the solid electrolyte; (C) forming negatively charged oxygen atoms at a surface of the solid electrolyte, an opposite surface on which the electrode A' is provided, by providing electric current to an electrode A on the opposite surface, to thereby produce negatively charged oxygen atoms from the oxygen ions; and (D) applying voltage to an electrode B spaced from the electrode A, in an amount sufficient to generate an electric potential between the electrode A and the electrode B, thereby causing the negatively charged oxygen atoms to move in the direction of the electrode B. The apparatus of the present invention can be used for the above method.

14 Claims, 6 Drawing Sheets

METHOD FOR GENERATING NEGATIVELY CHARGED OXYGEN ATOMS AND APPARATUS USED THEREFOR

BACKGROUND OF THE INVENTION

1. Field of the Invention

The present invention relates to a method for generating negatively charged oxygen atoms in a vapor phase and an apparatus used therefor, more specifically to a method for generating negatively charged oxygen atoms, which has advantageous merits in maintaining food freshness, such as inhibiting strawberry mold and maintaining tuna freshness, and which are used for air cleaners etc. to utilize their favorable effect on the human body, and an apparatus used therefor.

2. Discussion of the Related Art

Negatively charged oxygen atoms ($O^-$; atomic oxygen radical anion) have been conventionally produced by attaching low-energy electrons to oxygen atoms generated by electric discharge, etc. However, this method has a problem in that high energy is necessary for maintaining a high vacuum and for electric discharge or an electron gun.

Recently, a new method for generating negatively charged oxygen atoms has been proposed, in which ozone is generated by electrically discharging in an oxygen gas, the resulting ozone is irradiated with ultraviolet rays, and low-energy electrons are attached to the resulting oxygen atoms to produce $O^-$ (Japanese Patent Laid-Open No. 62-237733). In this method, a generator is used, which comprises a vacuum chamber having a window capable of irradiating ultraviolet, an electric discharge unit, and a low-energy electron gun. However, this generator has a complicated structure and also requires higher energy for electric discharge and the electron gun. In addition, a high vacuum is required to achieve electric discharge, which results in extremely high running cost.

On the other hand, a method in which dinitrogen monoxide is introduced to a surface of a thermally or chemically reduced metal oxide to produce $O^-$ on the metal oxide has been conventionally known. Specifically, a metal oxide, for instance, titanium monoxide, zinc oxide, aluminum oxide, or magnesium oxide, is thermally or chemically reduced, followed by introduction of dinitrogen monoxide to the surface thereof, to generate $O^-$ through the process of $N_2O \rightarrow O^-$ [Yuki Kagaku Gosei, Vol. 40, No. 8, (1982)].

In this method, however, the reaction site of a reaction substrate is limited to the metal oxide surface, because $O^-$ is generated thereon. For this reason, the reaction of $O^-$ with the reaction substrate depends on the oxidation state of the metal oxide, and in order to obtain the desired oxide, a metal oxide suitable for its purpose has to be selected. Also, this method has a problem in operation, because a dinitrogen monoxide gas is a toxic or laughing gas.

SUMMARY OF THE INVENTION

An object of the present invention is to provide a method for generating negatively charged oxygen atoms, in which negatively charged oxygen atoms ($O^-$; atomic oxygen radical anion) can be easily generated simply by applying low voltage without using complicated, expensive facilities, such as electric discharge equipment, high-vacuum equipment and electron ion guns, or special gases.

Another object of the present invention is provide an apparatus for generating negatively charged oxygen atoms using the above method.

The present inventors have found that negatively charged oxygen atoms can be efficiently generated by using an apparatus comprising a solid electrolyte having two electrodes on both sides of the surfaces, supplying an oxygen gas to one electrode to produce negatively charged oxygen atoms in the other electrode, and applying positive voltage to a further electrode, the electrode being arranged on the side where negatively charged oxygen atoms are produced in the space with a given interval. The present inventors have made further investigation based on this finding, and developed the present invention.

The present invention is concerned with the following:

1. A method for generating negatively charged oxygen atoms, comprising the following steps:
   (A) supplying oxygen to a surface of a solid electrolyte, at which the surface is provided an electrode A', while supplying electric current to the electrode A', to thereby form oxygen ions;
   (B) causing the oxygen ions formed in step (A) to be transmitted through the solid electrolyte;
   (C) forming negatively charged oxygen atoms at a surface of the solid electrolyte, an opposite surface on which the electrode A' is provided, by providing electric current to an electrode A on the opposite surface, to thereby produce negatively charged oxygen atoms from the oxygen ions; and
   (D) applying voltage to an electrode B spaced from the electrode A, in an amount sufficient to generate an electric potential between the electrode A and the electrode B, thereby causing the negatively charged oxygen atoms to move in the direction of the electrode B.
2. An apparatus comprising a solid electrolyte having oxygen ion conductivity; an electrode A and an electrode A' arranged on both sides of the surfaces of the solid electrolyte; an electrode B arranged on a side of the electrode A with a given interval; and a source of electric current to apply a potential of the electrode B exceeding that of the electrode A, wherein negatively charged oxygen atoms are generated in the direction from the electrode A to the electrode B by applying voltage thereto.

According to the method for generating negatively charged oxygen atoms and the apparatus used therefor of the present invention, negatively charged oxygen atoms (O–) can be easily generated simply by applying low voltage without using complicated expensive facilities, such as electric discharge equipment, high-vacuum equipment and electron ion guns, or special gases.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

Figure 1:
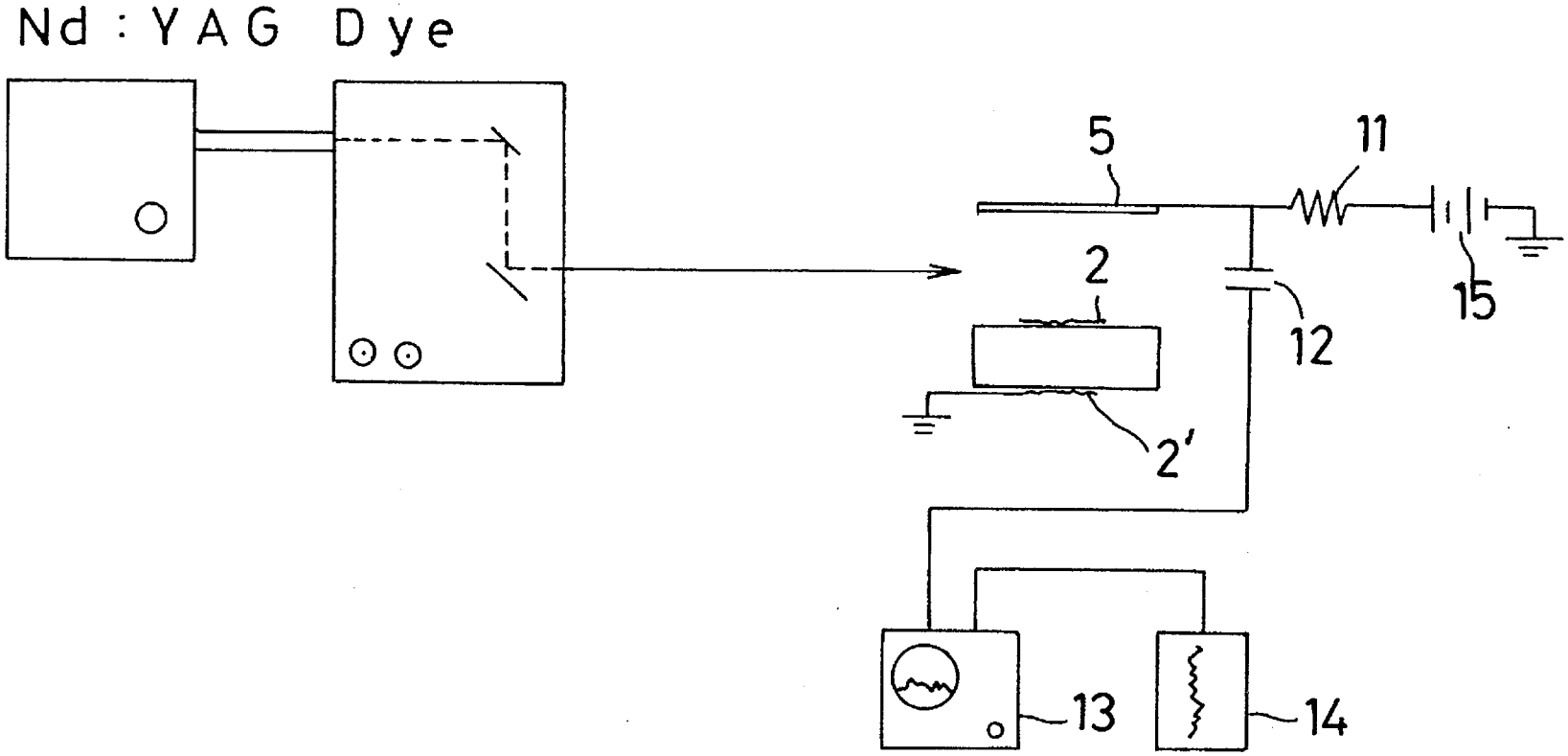
FIG. 1 is a schematic view showing a measuring system for confirming the generation of the negatively charged oxygen atoms in the present invention.

The reference numerals in FIGS. 1 through 6 denote the following elements:

1 denotes a solid electrolyte, 2 a gold electrode A, 2' a gold electrode A', 3 a portion for supplying an oxygen gas, 4 a generation site of negatively charged oxygen atoms, 5 a space electrode B, 6 a DC regulated power source, 7 an ammeter, 8 a glass reaction tube, 9 a vacuum pump, 10 a window for introducing laser, 11 a resistor, 12 a capacitor, 13 an oscilloscope, 14 a recorder, 15 a battery, 16 a device for supplying a rare gas, 21 is a cylindrical tube of a solid electrolyte, 22 a DC power source, 23 a heater, 23' a temperature controller, 24 a Q-MASS, 25 a device for controlling the Q-MASS equipped with an output portion (oscilloscope), 26 a pressure gauge, 27 a vacuum pump, 28 an ammeter, 29 a DC power source, and 30 a high-voltage capacitor.

DETAILED DESCRIPTION OF THE INVENTION

First, the apparatus for generating negatively charged oxygen atoms of the present invention will be explained below.

The apparatus of the present invention comprises a solid electrolyte having oxygen ion conductivity; an electrode A and an electrode A' arranged on both sides of the surfaces of the solid electrolyte; an electrode B arranged on a side of the electrode A with a given interval; and a source of electric current to apply a potential of the electrode B exceeding that of the electrode A, negatively charged oxygen atoms being generated in the direction from the electrode A to the electrode B by applying voltage to the electrode B.

More specifically, there are three embodiments: In the first embodiment, a source of electric current is connected with an electrode A' as a negative electrode and an electrode B as a positive electrode. In the second embodiment, electrodes A, A' are short-circuited. In the third embodiment, the apparatus further comprises a source of electric current connected with an electrode A as a positive electrode and an electrode A' as a negative electrode.

As mentioned above, in any of the embodiments of the present invention, negatively charged oxygen atoms can be generated. Each of the embodiments has the following features: In the first embodiment, oxygen ions can be taken out more easily, because a simple electric system for applying voltage between the electrodes is used. In the second embodiment, the free electrons produced on the electrode A are transferred to the electrode A' on the opposite side of the electrode A to prevent accumulation thereof. In the third embodiment, the amount of negatively charged oxygen atoms generated can be increased by increasing the transfer speed of the oxygen ions in the solid electrolyte.

Although the solid electrolyte used is not subject to limitation as long as it has oxygen ion conductivity, the solid electrolyte is preferably a metal oxide or a solid solution of different metal oxides, whose crystalline structure is a fluorite or perovskite structure. Examples of the solid electrolytes include cerium oxide, thorium oxide, zirconium oxide, hafnium oxide, bismuth oxide, strontium oxide, cobalt oxide, manganese oxide and titanium oxide; and solid solutions of one of the above metal oxides with magnesium oxide, calcium oxide, scandium oxide, yttrium oxide, lanthanum oxide, niobium oxide, tungsten oxide, neodymium oxide, samarium oxide, cadmium oxide, cobalt oxide, cerium oxide, barium oxide, erbium oxide, or ytterbium oxide. Of these solid electrolytes, a preference is given to zirconium oxide, cerium oxide, calcium oxide, manganese oxide, yttrium oxide, titanium oxide, and barium oxide, with a greater preference given to a solid solution of zirconium oxide with yttrium oxide.

Although the thickness of the solid electrolyte is not subject to limitation, it is normally 5 to 5000 μm, preferably 5 to 1000 μm. Thinner the solid electrolyte, higher the oxygen ion conductivity and thus greater the capability of generating negatively charged oxygen atoms. However, solid electrolytes having a thickness of not more than 5 mm are difficult to prepare and difficult to handle due to its problem in mechanical strength. When the solid electrolytes have a thickness of not more than 100 μm, a support that reinforce it is desirably provided. The support is preferably porous, which is capable of transmitting negatively charged oxygen atoms. Examples of the supports include glass filters and porous alumina.

Examples of methods for preparing solid electrolytes include, though not limited thereto, baking, plasma spraying, sol-gel process, vacuum coating, and sputtering.

The electrodes A, A' arranged on both sides of the surfaces of the solid electrolyte are not subject to limitation, as long as they are sufficiently electroconductive. Examples of the electrode materials include metals, such as gold, platinum, silver, copper, iron, aluminum, nickel, zinc, and lead, alloys of two or more metals, and carbon. The electrodes may be prepared by applying an electrode material in a paste form, or by coating the surface of the solid electrolyte by sputtering or vacuum coating, or by adhering a metal mesh to the solid electrolyte surface. The thickness of the coated electrode is preferably from 0.1 to 50 μm, more preferably from 0.5 to 10 μm.

The electrodes are preferably porous from the viewpoint of continuously supplying oxygen. Also, the electrodes have a large number of contact points with the solid electrolyte from the viewpoint of transfer and supplying of charging substances or electron.

In the first embodiment, the electrodes A, A' are arranged separately. In the second embodiment, the two electrodes are short-circuited by an electroconductive substance as described above. In the third embodiment, voltage is applied between electrodes by a source of electric current. Any conventional sources of electric current can be used without limitation, as long as they are capable of applying direct current voltage, and any of the conventionally known devices may be used. Specifically, examples of the devices include commonly used DC regulated power sources, commercially available dry cells, etc.

The apparatus of the present invention has an electrode B (hereinafter referred to as "space electrode") arranged at a given interval on the side where negatively charged oxygen atoms are produced (electrode A side), and which is one of the two spaces separated by a solid electrolyte having two electrodes.

The space electrode is to be sufficiently electroconductive for an electrode material. Examples of the electrode materials include metals, such as gold, platinum, silver, copper, iron, aluminum, nickel, zinc and lead, alloys of two or more metals, and carbon. This electrode may be prepared as a wire, a rod, a plate, or a metal mesh, by applying an electrode material in a paste form to the solid surface, or by coating the solid surface by sputtering or vacuum coating.

The distance between the electrode A on the solid electrolyte and the above-described space electrode is normally from 0.1 to 50 cm, preferably from 0.3 to 10 cm. When the distance is less than 0.1 cm, it may be inconvenient to use such an apparatus in the reaction for negatively charged oxygen atoms. When the distance exceeds 50 cm, the apparatus is likely to be too expensive because a high voltage has to be applied.

The apparatus of the present invention is equipped with a source of electric current to have the potential of the above-mentioned space electrode exceeding that of the electrode A. Specifically, in the first embodiment, the source of electric current is connected with the electrode A' as a negative electrode and the electrode B as a positive electrode to supply electrons to the electrode A'. In the second embodiment, it is not necessary to use the electrode A' as a negative electrode, because the electrodes A, A' are short-circuited and voltage is applied to the electrode B to have a potential thereof exceeding that of the electrode A in order to supply electrons from the source of electric current to the electrode A'. An example of a source of electric current may be a source of electric current in the third embodiment. In this embodiment, a potential is applied between electrodes A, A' to provide the electrode A as a positive electrode so as to promote oxygen ion conductivity, and voltage is further applied to the electrode B to have a potential of the electrode B exceeding that of the electrode A.

In the present invention, for the purposes of increasing the temperature of the solid electrolyte and thereby increasing the ion conductivity of the solid electrolyte, the apparatus is preferably further equipped with a temperature controlling device of the solid electrolyte. Examples of the temperature controlling devices include heaters capable of maintaining the solid electrolyte at a given temperature using a temperature controller, the heater being arranged so as to heat the entire solid electrolyte.

In the present invention, for the purposes of decreasing the oxygen concentration on the side where negatively charged oxygen atoms are generated and thereby increasing the amount of negatively charged oxygen atoms generated, the electrode A side, one of the spaces separated by the solid electrolyte, is preferably a closed system, and a vacuum pump is connected thereto, or a means for supplying a rare gas, or the like, is connected thereto. The vacuum pumps may be any kinds of known vacuum pumps. Useful rare gases include an argon gas, a nitrogen gas, a helium gas, a xenon gas, a krypton gas, and a neon gas.

Next, the method of the present invention for generating negatively charged oxygen atoms will be explained.

The method of the present invention can be efficiently performed using the above-mentioned apparatus of the present invention. Specifically, the method of the present invention is a method for generating negatively charged oxygen atoms, comprising the following steps:

(A) supplying oxygen to a surface of a solid electrolyte, at which the surface is provided an electrode A', while supplying electric current to the electrode A', to thereby form oxygen ions;

(B) causing the oxygen ions formed in step (A) to be transmitted through the solid electrolyte;

(C) forming negatively charged oxygen atoms at a surface of the solid electrolyte, an opposite surface on which the electrode A' is provided, by providing electric current to an electrode A on the opposite surface, to thereby produce negatively charged oxygen atoms from the oxygen ions; and (D) applying voltage to an electrode B spaced from the electrode A, in an amount sufficient to generate an electric potential between the electrode A and the electrode B, thereby causing the negatively charged oxygen atoms to move in the direction of the electrode B.

There are three embodiments of the method of the present invention, each of which corresponds to the above-described apparatus of the present invention. In the first embodiment, voltage is applied in step (D) using the electrode A' as a negative electrode and the electrode B used as a positive electrode. In the second embodiment, the electrodes A, A' are short-circuited, so that the electrons discharged on the electrode A side are transferred to the electrode A'. In the third embodiment, voltage is further applied between the electrode A used as a positive electrode and the electrode A' used as a negative electrode.

Specific conditions will be explained below.

In the third embodiment, the voltage applied between the electrodes A, A' on both sides of the solid electrolyte is normally not less than 0.1 V/mm, preferably not less than 0.5 V/mm, as per mm thickness of the solid electrolyte. The amount of negatively charged oxygen atoms produced is regulated by the voltage applied between the two electrodes. In other words, the amount of negatively charged oxygen atoms produced can be increased by increasing the positive (+) voltage applied on the side where negatively charged oxygen atoms are produced. In all embodiments, it is expected that active oxygen species other than negatively charged oxygen atoms are also produced by the mechanism explained below.

In the present invention, oxygen is supplied to the electrode A' side. Although oxygen can be simply supplied by exposing the electrode to the atmosphere, it may be supplied using a high-pressure gas cylinder of oxygen or an oxygen mixture, such as air, an air pump or an air compressor.

The oxygen supplied to the electrode A' side is given electrons from the electrode A' and becomes oxygen ions, which transmit through the solid electrolyte. On the electrode A side, the oxygen ions transmitted through the solid electrolyte discharge electrons, resulting in the formation of negatively charged oxygen atoms.

At that time, the oxygen is preferably removed on the side where negatively charged oxygen atoms are generated. For this purpose, the oxygen is supplied under a reduced pressure or supplied with a rare gas, or the like.

The negatively charged oxygen atoms thus produced on the surface of the solid electrolyte are diffused and transferred in the direction of the electrode B by applying voltage to have the potential of the electrode B exceeding that of the electrode A. The voltage applied to the space electrode B is normally not less than +1 V/cm, preferably not less than +10 V/cm.

Although the temperature when generating negatively charged oxygen atoms, i.e., the solid electrolyte temperature, is set according to the solid electrolyte used, the temperature is preferably from 200°to 800° C., more preferably from 350°to 600° C. in order to increase the ion conductivity of the solid electrolyte.

In the present invention, therefore, the negatively charged oxygen atoms can be obtained in a vapor phase without using special gases, electric discharge equipment, high vacuum equipment, electron guns, etc. required in conventional methods.

In the present invention, the method for generating negatively charged oxygen atoms may be utilized in maintaining food freshness, etc. by the following method. For instance, the negatively charged oxygen atoms generated are carried along with a helium gas or the like and introduced into a chamber containing subject foods. Specifically, strawberries to be subjected to freshness treatment are so arranged in a chamber that the strawberries uniformly contact the negatively charged oxygen atoms. In such cases, the treatment time depends upon the amount of the materials to be treated.

The mechanism for generating negatively charged oxygen atoms is presumably as follows:

Oxygen ion conductors, particularly metal oxides or solid solutions of different metal oxides whose crystalline structure is a fluorite structure, or the like, conduct oxygen ions via a lattice defect of oxygen ions. This conductivity increases as the temperature increases or the thickness decreases. When both sides of this solid electrolyte are coated with an electroconductive material, such as a metal, and oxygen is introduced to one side (cathode), the following reaction takes place on the electrode surface:

$$\tfrac{1}{2}o_2+2e^-\rightarrow O^{2-}$$

The resulting oxygen ions enter the lattice defect in the solid electrolyte and migrate in the solid electrolyte. On the electrode surface on the other side (anode), the coming oxygen ions undergo one of the following reaction:

$$O^{2-}\rightarrow O^-+e^-$$

or $$2O^{2-}\rightarrow O_2{}^*+4e^-.$$

In the above reaction, $O^-$ and $O_2{}^*$ are produced on the electrode surface or on the solid electrolyte. By applying a positive voltage on a space electrode, $O^-$ migrates and diffuses between the electrode surface and the space electrode, resulting in the generation of $O^-$.

The presence of negatively charged oxygen atoms generated by the solid electrolyte is confirmed by measuring the threshold of photoelectron dissociation energy. From a data base, the photoelectron dissociation energy threshold of the negatively charged oxygen atoms is known to be about 1.5 eV, equivalent to a wavelength of about 850 nm as calculated [J. Chem. Phys. Ref. Data, Vol. 4, No. 3, (1975) and Phys. Review, Vol. 111, No. 2, 504 (1958)]. For this reason, measurement is conducted by selecting an appropriate laser wavelength, irradiating a generation site of the negatively charged oxygen atoms with a laser beam having energy levels near the threshold, and detecting temporal changes in amperage to determine whether or not electrons are dissociated.

The laser used for measurement is Dye LASER "Hyper Dye 300" (manufactured by Lumonics), together with a pumping laser "Nd:YAG" (manufactured by Quanta-Ray). These laser beams in combination are irradiated (about 1 mJ/P) at wavelengths of 320 nm, 660 nm and 1064 nm. To determine whether or not the electrons of negatively charged oxygen atoms are dissociated at these laser wavelengths, voltage is applied between the electrode of the surface of the solid electrolyte and the space electrode during wavelength scanning, and the changes in amperage between the two electrodes are measured. The current is measured by using a resistor as shown in FIG. 1 so that resulting current is measured in terms of voltage, and obtaining the voltage between the two electrodes using an oscilloscope. The electric circuit and measuring system used are schematically shown in FIG. 1. This system corresponds to the first embodiment.

The results demonstrate that the substances generated by applying voltage between the electrode on the surface of the solid electrolyte and the space electrode dissociate electrons at a laser wavelength between 660 nm and 1064 nm, as determined by amperometry, and the presence of a substance having electron dissociation energy between these wavelengths is confirmed. Anticipated substances having electron dissociation energy between the wavelengths used are the negatively charged oxygen atoms ($O^-$). It is, therefore, found that the gaseous substances obtained via the solid electrolyte are the negatively charged oxygen atoms.

It is also found that by increasing the potential between the two electrodes arranged on both sides of the surfaces of the solid electrolyte, the amount of oxygen ions migrating in the solid electrolyte is increased, resulting in an increased amperage observed in the above-mentioned experiment.

EXAMPLES

The present invention will be further detailed by means of the following Examples, without intending to restrict the scope of the present invention thereto.

Example 1

Figure 2:
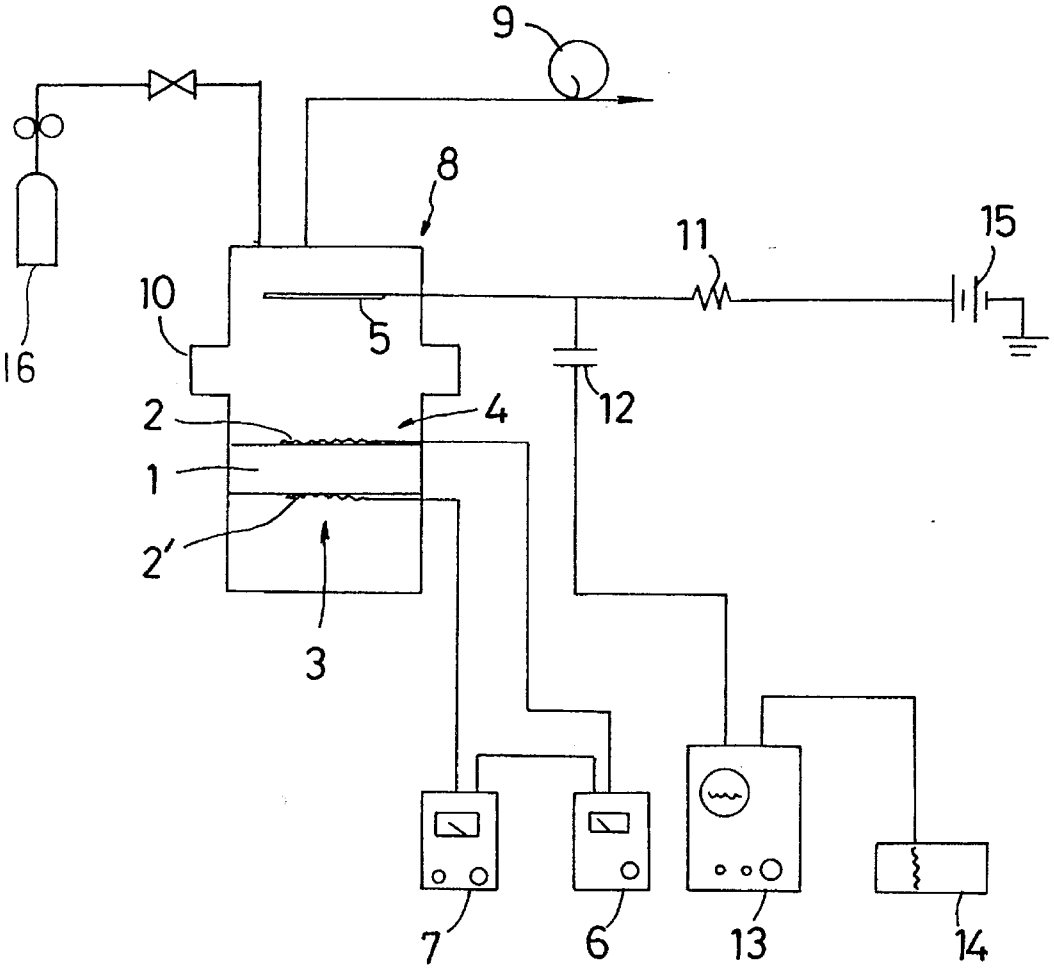
FIG. 2 is a schematic view showing an example of the apparatus for generating negatively charged oxygen atoms used in Example 1.

FIG. 2 is a schematic view showing an example of the apparatus of the present invention for generating negatively charged oxygen atoms.

In FIG. 2, the numerical symbols denote the following: 1 is a disk of zirconium oxide containing 8 mol % yttrium oxide as a solid solution (manufactured by Japan Fine Ceramics, thickness 0.2 mm, diameter 80 mm), which is a solid electrolyte serving as an oxygen ion conductor. 2 is a gold electrode A and 2' is a gold electrode A', which are prepared on the both sides of the solid electrolyte to have a thickness of about 5 μm by applying with a brush pasty gold (manufactured by Nippon Kineki K. K.). 3 is a portion for supplying oxygen to the solid electrolyte, which is in contact with air in the reaction tube. 4 is a generation site of negatively charged oxygen atoms. 5 is a space electrode B arranged 1 cm away from the surface of the electrode A in the space on the side where the negatively charged oxygen atoms are generated. 6 is a DC regulated power source for applying voltage to the solid electrolyte. 7 is an ammeter for measuring the amperage flowing in the system when voltage is applied. 8 is a glass reaction tube of 100 cc capacity, which is connected to a vacuum pump 9 and/or a device for supplying a rare gas 16, so that only the side where the negatively charged oxygen atoms are generated is subject to reduced pressure and/or supplying of a rare gas, which is designed to have a temperature setting of up to 1000° C. 10 is a window for introducing laser for photoelectron dissociation for confirming the presence of negatively charged oxygen atoms. The electrons dissociated from the negatively charged oxygen atoms by laser are collected by the space electrode and observed as voltage changes with an oscilloscope 13 via an electric circuit consisting of a resistor 11 and a capacitor 12, and the results are recorded on a recorder 14.

15 is a 100 V battery for applying a positive voltage to the space electrode, with its negative electrode grounded.

Figure 3:
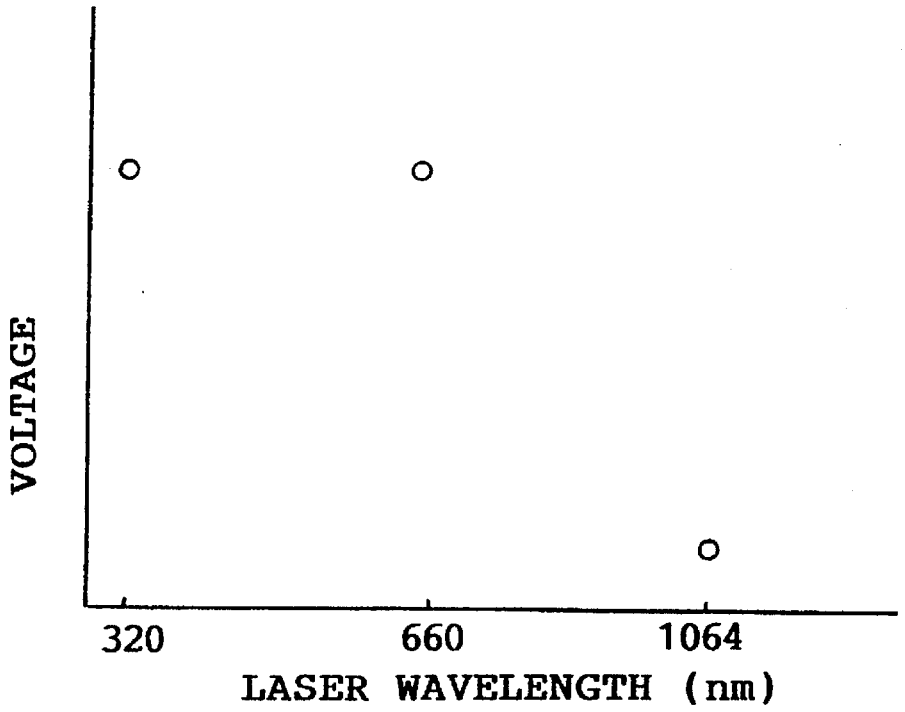
FIG. 3 is a graph showing the relationship between laser wavelength and voltage produced in dissociating electron measured in Example 1.

To confirm the actual generation of negatively charged oxygen atoms in this apparatus, the following operation was conducted. After the high-temperature furnace of the reaction tube 8 was previously set at 500° C., the inside pressure of the system was reduced to 0.1 Torr using a vacuum pump. The reduced pressure was confirmed using a vacuum meter attached to the vacuum pump. Next, a potential of 100 V was applied between the electrode A on the upper portion of the solid electrolyte and the space electrode B. To the apparatus for generating negatively charged oxygen atoms with the above settings, 320 nm, 660 nm, and 1064 nm laser beams are irradiated through a laser introducing window 10. The voltage observed upon electron dissociation was recorded. The results are shown in FIG. 3.

Figure 4:
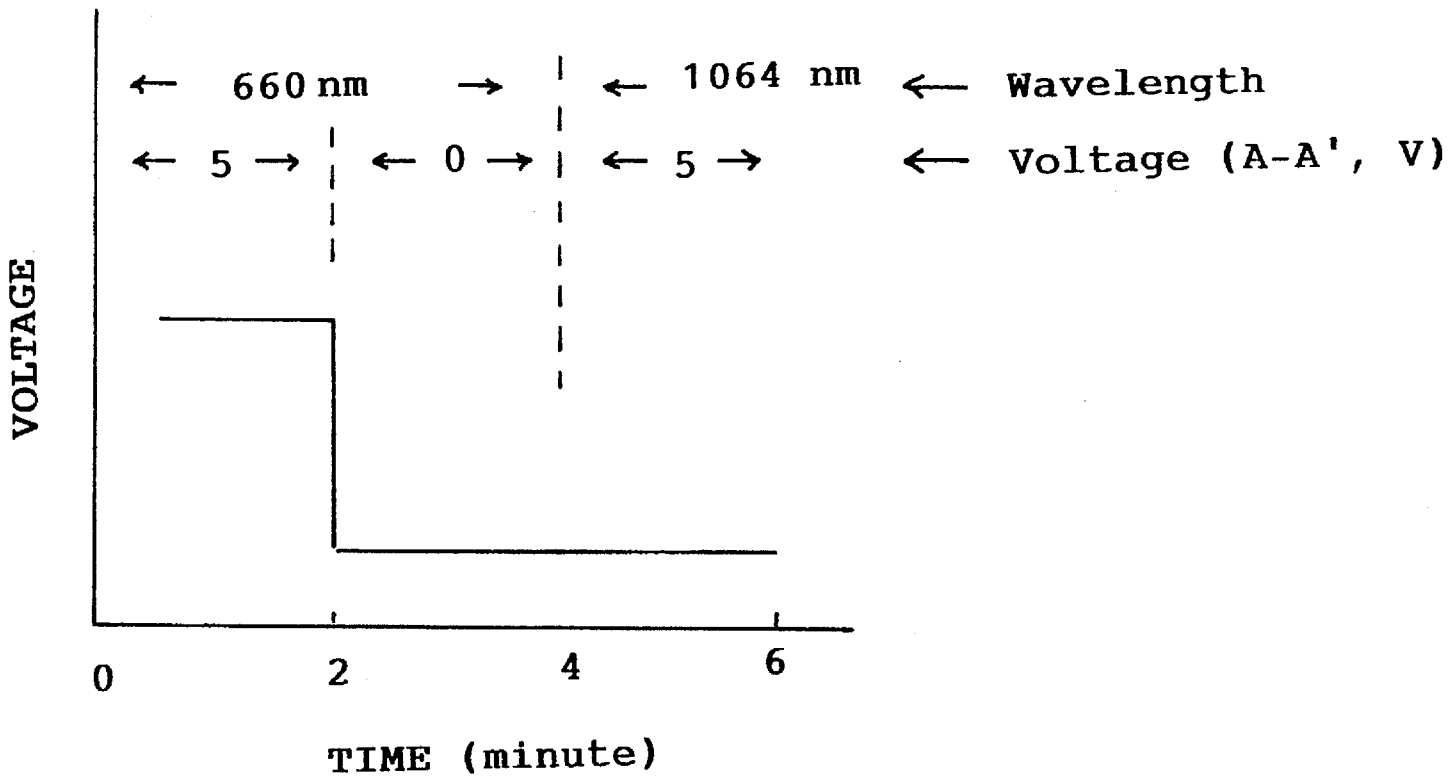
FIG. 4 is a graph showing the relationships between various conditions in Example 1, for instance, laser wavelength or applied voltage and voltage produced in dissociating electron.

To confirm whether or not the amount of negatively charged oxygen atoms generated was increased by increase in the voltage applied to the two electrodes of the solid electrolyte, the following operation was conducted. While a laser beam was irradiated to the apparatus, with a laser wavelength set to not less than the wavelength corresponding to the electron dissociation energy of negatively charged oxygen atoms (660 nm fixed wavelength), a voltage of 5 V was continuously applied between the electrodes A, A' for several minutes (the third embodiment). Next, the applied voltage was decreased to 0 (the second embodiment), and the current phenomenon between the electrodes A, B was observed. Subsequently, the laser wavelength was set to not more than the wavelength corresponding to the electron dissociation energy of negatively charged oxygen atoms (1064 nm fixed wavelength). While this laser beam was irradiated to the apparatus, the changes in amperage between the electrodes were observed. The results are shown in FIG. 4. As is clear from FIG. 3, it was evident that the gaseous substances generated in this reaction tube was negatively charged oxygen atoms having an electron dissociation energy threshold at a laser wavelength between 660 nm and 1064 nm. As is clear from FIG. 4, it was evident that the amount of negatively charged oxygen atoms generated is increased by increasing the amount of current between the two electrodes of the solid electrolyte.

In the above Example, by using a device for supplying a rare gas, the negatively charged oxygen atoms produced between the electrode A and the space electrode B are carried along with a supplied helium gas and introduced into a chamber where strawberries are placed on a porous plate.

The freshness-maintaining states of the ion-treated strawberries and the untreated strawberries are observed by evaluating changes with respect to time after placing both kinds of strawberries in a thermostat. Although no molding is observed after 10 days for the ion-treated strawberries, the untreated ones shows moldings on the surface of the strawberries after 3 days.

Example 2

Figure 5:
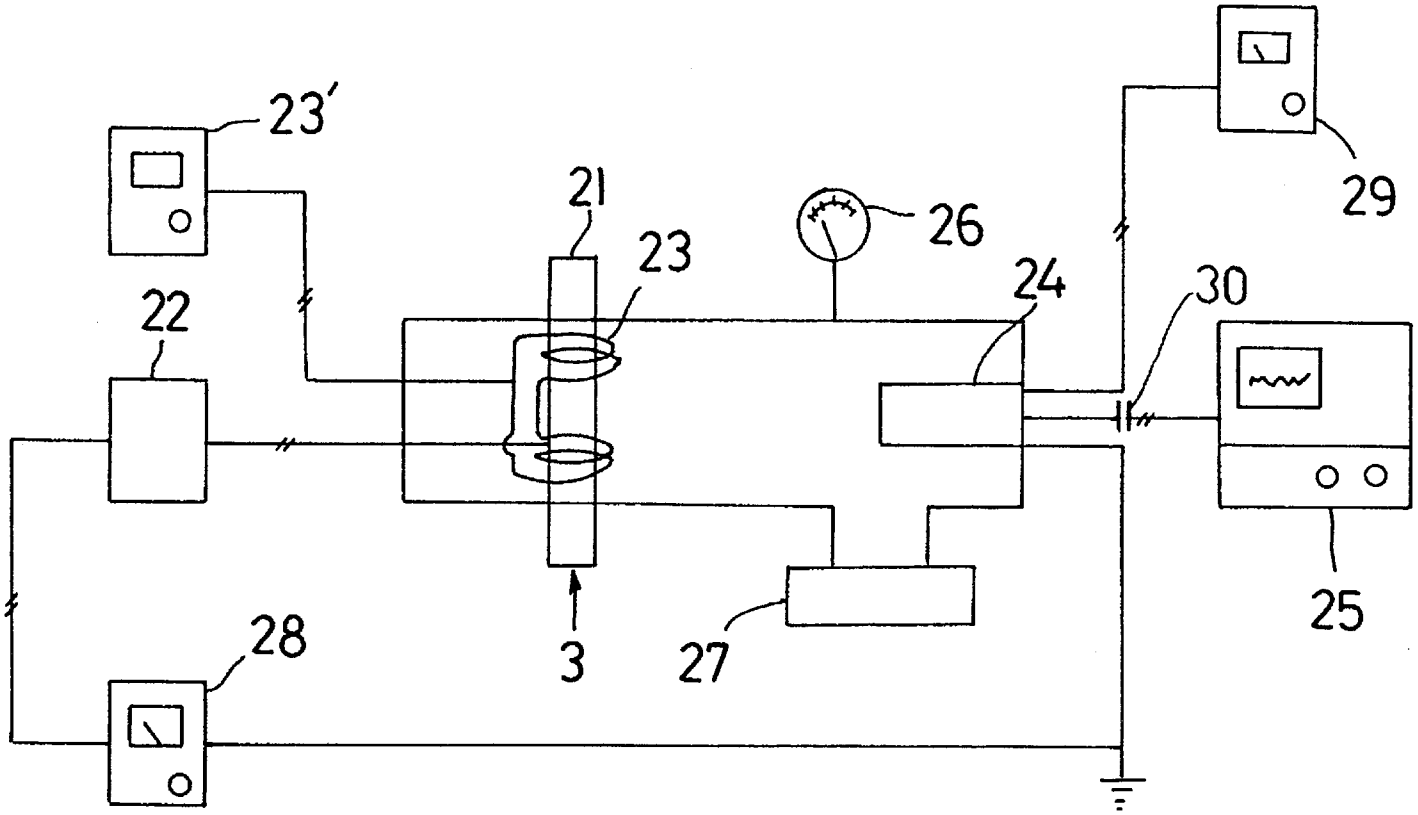
FIG. 5 is a schematic view showing an example of the apparatus for generating negatively charged oxygen atoms used in Example 2.

FIG. 5 shows an example of the apparatus of the present invention for generating negatively charged oxygen atoms.

In FIG. 5, the numerical symbols denote the following: 21 is a cylindrical tube of zirconium oxide containing 8 mol % yttrium oxide as a solid solution (manufactured by Nippon Kagaku Togyo Co., Ltd., thickness 1 mm, diameter 20 mm, length 300 mm), a solid electrolyte that serves as an oxygen ion conductor, with a gold electrode (thickness about 5 μm), the cylindrical tube being coated on both the inner and outer surfaces thereof. The inner surface of the cylinder was exposed to the atmosphere. 22 is a DC power source for applying DC voltage between the electrode arranged on the inner surface of the solid electrolyte and a platinum mesh (corresponding to a space electrode) provided in front of a quadrupole of a Q-MASS (mass analyzer). 23 and 23' are a heater and a temperature controller, respectively, which are used for heating the solid electrolyte. 24 is a modified Q-MASS (mass analyzer having a quadrupole and a detector in one unit) to measure negatively charged ions. 25 is a device for controlling the Q-MASS and a measuring result output portion (oscilloscope). 26 is a pressure gauge for measuring the inside pressure of the system. 27 is a vacuum pump connected to permit pressure reduction only on the side for generating the negatively charged oxygen atoms. 28 is an ammeter for observing the current between the solid electrolyte and the Q-MASS. 29 is a DC power source for applying a positive voltage to the Q-MASS detector. This apparatus corresponds to the first embodiment.

To determine the mass of the negatively charged oxygen atoms actually produced by this apparatus, the following operation was conducted. After previously setting the temperature of the solid electrolyte 21 at 400° C. using the heater 23, the inside pressure of the system was reduced to $10^{-6}$ Torr using the vacuum pump 27. The degree of vacuum in the system was confirmed using the pressure gauge 26, and it was also confirmed that the temperature of the solid electrolyte reached the set temperature. Next, with the electrode arranged on the inner surface of the solid electrolyte as a negative electrode and the Q-MASS grounded, a potential of 100 V was applied between the two electrodes using the DC power source 22. In this operation, generation of ionic current between the two electrodes was observed using the ammeter 28.

Figure 6:
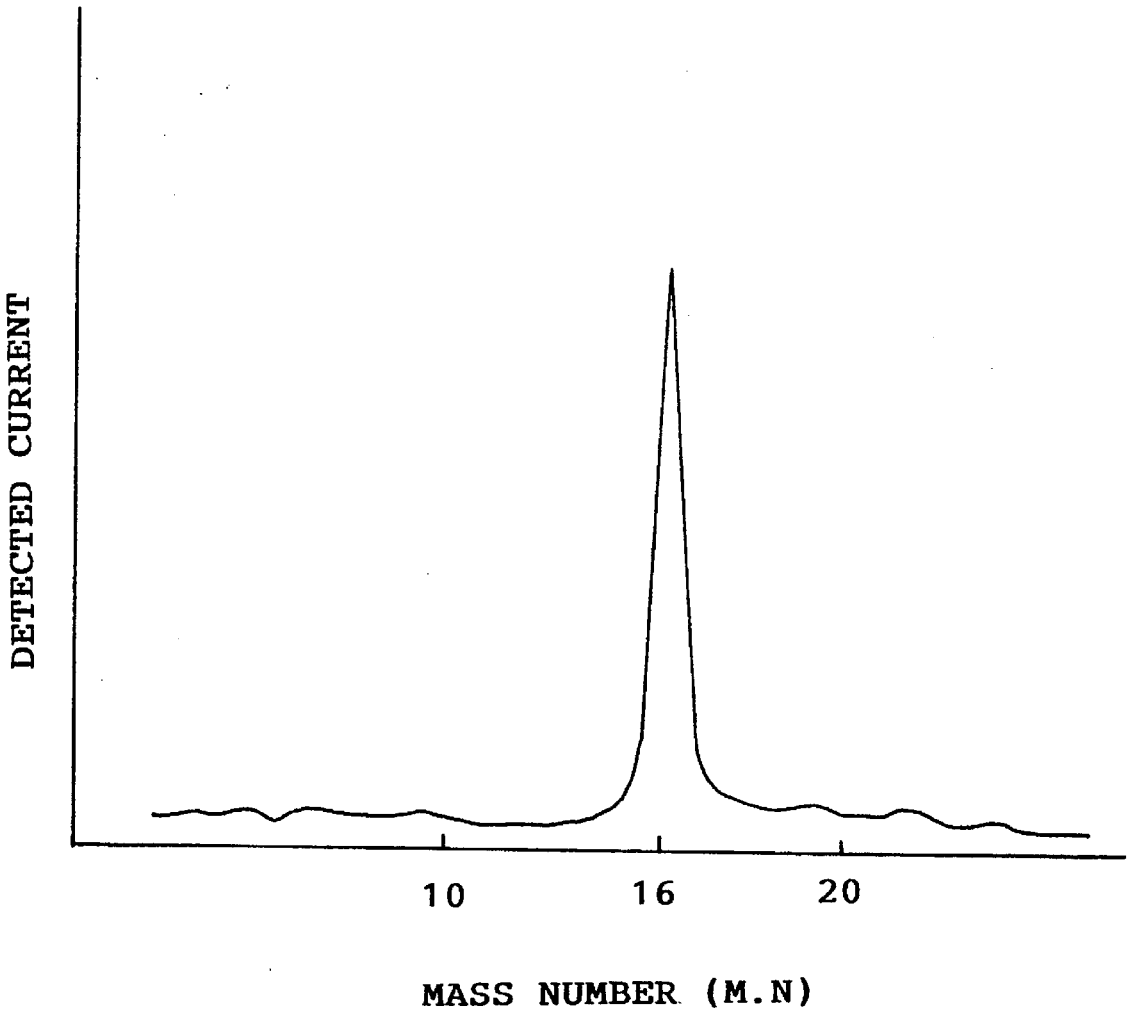
FIG. 6 is a graph showing the relationship between mass number and detected current measured in Example 2.

After confirmation of generation of ionic current between the two electrodes, a positive potential of +3 kV was applied to the Q-MASS detector for operating a secondary electron multiplier, and the mass number (M.N.) was changed using a Q-MASS mass controller. Thereafter, the current generated in the Q-MASS detector during mass change was observed using an oscilloscope attached to the Q-MASS mass controller. The results are shown in Figure 6, confirming a major change in detection signal at a mass number of 16. From these results, it was also confirmed that negatively charged oxygen atoms are generated.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for generating negatively charged oxygen atoms, comprising the following steps:

(A) supplying oxygen to a surface of a solid electrolyte, at which the surface is provided an electrode A', while supplying an electric current to the electrode A', to form oxygen ions ($O^{2-}$);

(B) causing the oxygen ions formed in step (A) to be transmitted through said solid electrolyte;

(C) forming negatively charged oxygen atoms ($O^-$) from said oxygen ions at a surface of said solid electrolyte, an opposite surface on which the electrode A' is provided, the by providing the electric current to an electrode A on said opposite surface; and (D) applying voltage to an electrode B spaced from said electrode A, and away from the solid electrolyte in an amount sufficient to generate an electric potential between the electrode A and the electrode B, causing said negatively charged oxygen atoms to migrate and diffuse from the electrode A towards the electrode B.

2. The method according to claim 1, wherein the voltage is applied in step (D) using the electrode A' as a negative electrode and the electrode B as a positive electrode.

3. The method according to claim 1, wherein the electrodes A and A' are short-circuited,transferring electrons discharged on the electrode A side to the electrode A'.

4. The method according to claim 1, wherein the solid electrolyte has a thickness from 5 to 1,000 μm .

5. The method according to claim 1, wherein the solid electrolyte is at a temperature from 200°to 800° C.

6. The method according to claim 1, wherein the space between the electrodes A and B is a closed system, further comprising the step of reducing an inside pressure of the closed system.

7. An apparatus comprising a solid electrolyte having oxygen ion conductivity an electrode A and an electrode A' arranged on both sides of surfaces of the solid electrolyte; an electrode B spaced from electrode A and away from the solid electroytre; a means for supplying oxygen to a surface of the solid electrolyte; a means for supplying an electric current to the electrolyte A' and A and a means for supplying electric current to electrode B exceeding that supplied to electrode A, to create an electric potential at electrode B exceeding that electrode A, such that negatively charged oxygen atoms are generated in the direction from the electrode A to the electrode B.

8. The apparatus according to claim 7, wherein the means for supplying electric current to the electrode B is connected with the electrode B as a positive electrode and the electrode A' as a negative electrode.

9. The apparatus according to claim 7, wherein the electrodes A and A' are short-circuited.

10. The apparatus according to claim 7, wherein the means for supplying electric current to tho the electrodes A' and A is connected with the electrode A' as a negative electrode and the electrode A as a positive electrode.

11. The apparatus according to claim 7, wherein the solid electrolyte has a thickness from 5 to 1,000 μm.

12. The apparatus according to claim 7, further comprising a temperature controlling device of the solid electrolyte.

13.The method according to Claim 1, further comprising the steps of applying a voltage to the electrode A' less than the voltage supplied to the electrode A, such that the electrode A' is used as a negative electrode.

14. The apparatus according to claim 7, further comprising a vacuum pump, wherein the space between the electrodes A and B a means for supplying oxygen to a surface of the solid electrolyte; a means for supplying an electric current to the electrodes A' and A is a closed system, and the vacuum pump is connected to the closed system. electrolyte; a means for supplying oxygen to a surface of the solid electrolyte; a means for supplying an electric current to the electrodes A' and A and a means for supplying electric current to electrode B exceeding that supplied to electrode A, to create an electric potential at electrode B exceeding that electrode A, such that negatively charged oxygen atoms are generated in the direction from the electrode A to the electrode B.

* * * * *